United States Patent [19]

Mushiake et al.

[11] Patent Number: 5,051,140

[45] Date of Patent: Sep. 24, 1991

[54] SURFACE TREATMENT METHOD FOR TITANIUM OR TITANIUM ALLOY

[75] Inventors: Moriyuki Mushiake, Kyoto; Kenichi Asano, Kusatsu; Noriyuki Miyamura, Kyoto, all of Japan

[73] Assignee: Mitsubishi Jidosha Kogyo Kabushiki Kaisha, Tokyo, Japan

[21] Appl. No.: 489,443

[22] Filed: Mar. 6, 1990

[30] Foreign Application Priority Data

Mar. 23, 1989 [JP] Japan ..... 1-69171

[51] Int. Cl.[5] ..... C21D 1/56; C23C 8/06

[52] U.S. Cl. ..... 148/203; 148/133; 148/158; 148/281

[58] Field of Search ..... 148/20.3, 133, 158, 148/281, 284, 285

[56] References Cited

FOREIGN PATENT DOCUMENTS

| | | |
|---|---|---|
| 1188302 | 3/1965 | Fed. Rep. of Germany . |
| 1451393 | 9/1966 | France . |
| 2250831 | 6/1975 | France . |
| 61-243165 | 10/1986 | Japan . |
| 62-149859 | 7/1987 | Japan . |
| 62-280353 | 12/1987 | Japan . |
| 63-235460 | 9/1988 | Japan . |
| 01046342 | 7/1983 | U.S.S.R. . |
| 2118978 | 9/1983 | United Kingdom . |

*Primary Examiner*—R. Dean
*Assistant Examiner*—Robert R. Koehler
*Attorney, Agent, or Firm*—Abelman Frayne Rezac & Schwab

[57] ABSTRACT

A method for treating the surface of a titanium alloy comprising a pretreatment process for cleaning a workpiece to be treated comprising a titanium alloy with an acid, a heating process for heating the pretreated workpiece in an oxidative atmosphere for a predetermined period of time to form a composite layer comprising oxide layers and oxygen-enriched layers on the surface of the workpiece, and a descaling process for rapidly quenching the treated workpiece to remove a scale layer formed as an outermost layer of the composite layer on the surface of the workpiece; or, without the pretreatment process, comprising the heating process, the descaling process, and an aging process for aging by maintaining the workpiece at a predetermined temperature; or, comprising the pretreatment process, the heating process, the descaling process, and the aging process, thereby adequately improving the abrasion resistance and burning resistance of the workpiece and preventing an increase in abrasion of a partner part sliding with the titanium alloy part, thus improving the durability.

9 Claims, 6 Drawing Sheets

SURFACE TREATMENT METHOD FOR TITANIUM OR TITANIUM ALLOY

BACKGROUND OF THE INVENTION

This invention relates to a method of treating the surface of titanium or a titanium alloy (hereinafter titanium or a titanium alloy is simply referred to as a titanium alloy) to obtain a titanium alloy that can be used in parts sliding with other types of metals.

In general, various types of metal materials are used, for example, in engine parts for a vehicle. Heretofore, some of these engine parts have been made from titanium alloys which are smaller in specific gravity than steel materials, thereby reducing the weight of the entire engine. However, when parts made of titanium alloys which are not processed by a special surface treatment are used in parts sliding with other types of metals, the titanium alloy parts tend to cause burning with other metals or undergo considerable abrasion. In order to prevent this, titanium alloy parts have been surface treated by nitriding, cementation, or plating.

However, when a titanium alloy part is surface treated such as by nitriding, hardness of the part is remarkably increased, which tends to increase abrasion of a metal part sliding with the titanium alloy part. When the surface of a titanium alloy part is plated, the coating layer tends to peel during sliding with partner metal parts, thus posing a reliability problem. Therefore, development of a low-cost and reliable surface treatment method has been in demand.

SUMMARY OF THE INVENTION

With a view to eliminate the above prior art problems of surface treatment methods for a titanium alloy, it is a primary object of the present invention to provide a method for treating the surface of a titanium alloy that improves burning resistance and abrasion resistance of the titanium alloy and prevents abrasion of a partner part sliding with the titanium alloy from increasing, thereby improving durability.

In accordance with the present invention which attains the above object, there is provided a first method for treating the surface of a titanium alloy comprising a pretreatment process for cleaning a workpiece to be treated comprising a titanium alloy with an acid, a heating process for heating the pretreated workpiece in an oxidative atmosphere for a predetermined period of time to form a composite layer comprising oxide layers and oxygen-enriched layers on the surface of the workpiece, and a descaling process for rapidly quenching the treated workpiece to remove a scale layer formed as an outermost layer of the composite layer on the surface of the workpiece.

When the pretreated workpiece is subjected to the oxidation treatment comprising the heating process and the descaling process, an oxide film formed by the oxidation treatment provides close adhesion to the titanium alloy, thereby obtaining improved abrasion resistance. Thus, abrasion resistance and burning resistance of the titanium alloy part are improved as compared with the case of only the oxidation treatment process, and abrasion of a partner part sliding with the titanium alloy part is prevented from increasing, thereby improving the durability.

There is also provided according to the present invention a second method for treating the surface of a titanium alloy comprising a heating process for heating a workpiece to be treated comprising a titanium alloy in an oxidative atmosphere for a predetermined period of time to form a composite layer comprising oxide layers and oxygen-enriched layers on the surface of the workpiece, a descaling process for rapidly quenching the workpiece to remove a scale layer formed as an outermost layer of the composite layer on the surface of the workpiece, and an aging process for aging by maintaining the workpiece at a predetermined temperature.

Abrasion resistance and burning resistance of the workpiece can also be improved by subjecting the workpiece to the oxidation treatment without pretreatment and then to the aging treatment. By the heating during the oxidation treatment of the workpiece comprising the titanium alloy, a solution treatment of the workpiece is also made. Thus, after the oxidation treatment, when the workpiece is maintained at a predetermined temperature for aging, the hardness of the titanium alloy is increased, thereby obtaining improved abrasion resistance.

There is further provided according to the present invention a third method for treating the surface of a titanium alloy comprising a pretreatment process for cleaning a workpiece to be treated comprising a titanium alloy with an acid, a heating process for heating the pretreated workpiece in an oxidative atmosphere for a predetermined period of time to form a composite layer comprising oxide layers and oxygen-enriched layers on the surface of the workpiece, a descaling process for rapidly quenching the workpiece to remove a scale layer formed as an outermost layer of the composite layer on the surface of the workpiece, and an aging process for aging by maintaining the workpiece at a predetermined temperature.

By subjecting the workpiece to the oxidation treatment after pretreatment and then to the aging treatment, abrasion resistance and burning resistance of the workpiece can be even further improved, and abrasion of a partner part sliding with the titanium alloy part is prevented from increasing, thereby improving the durability.

DETAILED DESCRIPTION OF PREFERRED EMBODIMENTS

Figure 2:
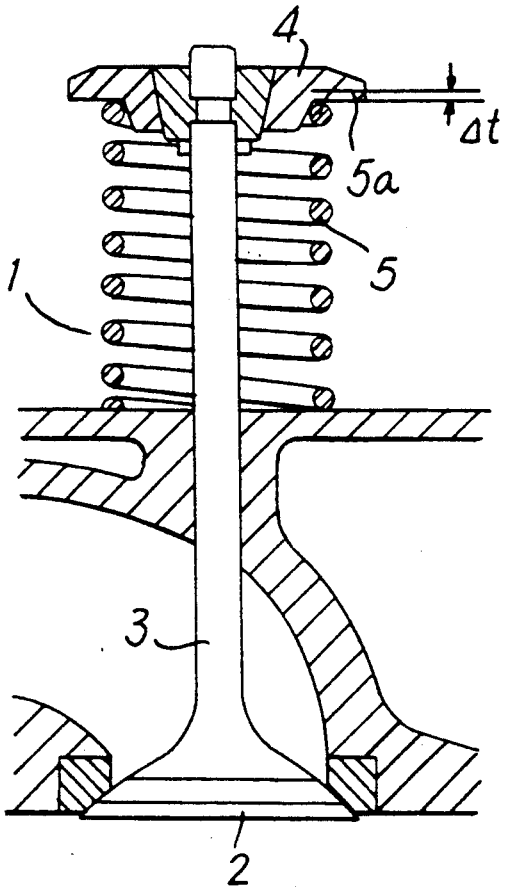
FIG. 2 is a schematic cross sectional view showing structure of a valve mechanism of an engine in the embodiments.

FIG. 2 is a schematic view showing part of a valve mechanism 1 of an engine, wherein numeral 2 denotes a valve member of an intake valve or exhaust valve. A valve spring retainer 4 is mounted to an upper end of a valve stem 3 of the valve member 2. An upper end of a valve spring 5 disposed around the valve stem 3 of the valve member 2 is pressed against a valve spring retainer 4. In this case, the valve spring 5 is made of, for example, a steel material, and the valve spring retainer 4 is made of titanium or a titanium alloy, for example, a Ti-22V-4Al alloy, which is a $\beta$-type titanium alloy.

Other types of metals to which the surface treatment method of the present invention can be applied include pure titanium which is an $\alpha$-type metal; Ti-5Al-2.5Sn which is an $\alpha$-type titanium alloy; Ti-5Al-6Sn-2Zr-1Mo-0.2Si, Ti-8Al-1Mo-1V, and Ti-6Al-2Sn-4Zr-2Mo which are near-$\alpha$-type titanium alloys; Ti-6Al-4V, Ti-6Al-6V-2Sr, Ti-6Al-2Sn-4Zr-6Mo, and Ti-8Mn which are $\alpha+\beta$-type titanium alloys; Ti-13V-11Cr-3Al, Ti-8Mo-8V-2Fe-3Al, Ti-3Al-8V-6Cr-4Mo-4Zr (called $\beta$C), and Ti-11.5Mo-6Cr-4.5Sn (called $\beta$III).

An example using the valve spring retainer 4 as a workpiece to be surface treated will be described below.

Embodiment 1

The valve spring retainer 4 was pretreated by ultrasonically cleaning in hydrochloric acid for 10 minutes.

This pretreatment is to remove impurities such as oil films and oxides from the surface of the titanium alloy, and a positive cleaning effect is achieved by the use of the ultrasonic cleaning in hydrochloric acid or nitric acid.

After the pretreatment process, the valve spring retainer 4 was heated for 30 minutes in an oxidative atmosphere, e.g., in the atmosphere at a temperature of 900° C. to form a composite layer comprising oxide layers and oxygen-enriched layers on the surface of the workpiece (heating process). After the heating process, the workpiece was rapidly quenched with water to remove a scale layer of a surface composite layer of the workpiece (descaling process).

Figure 3:
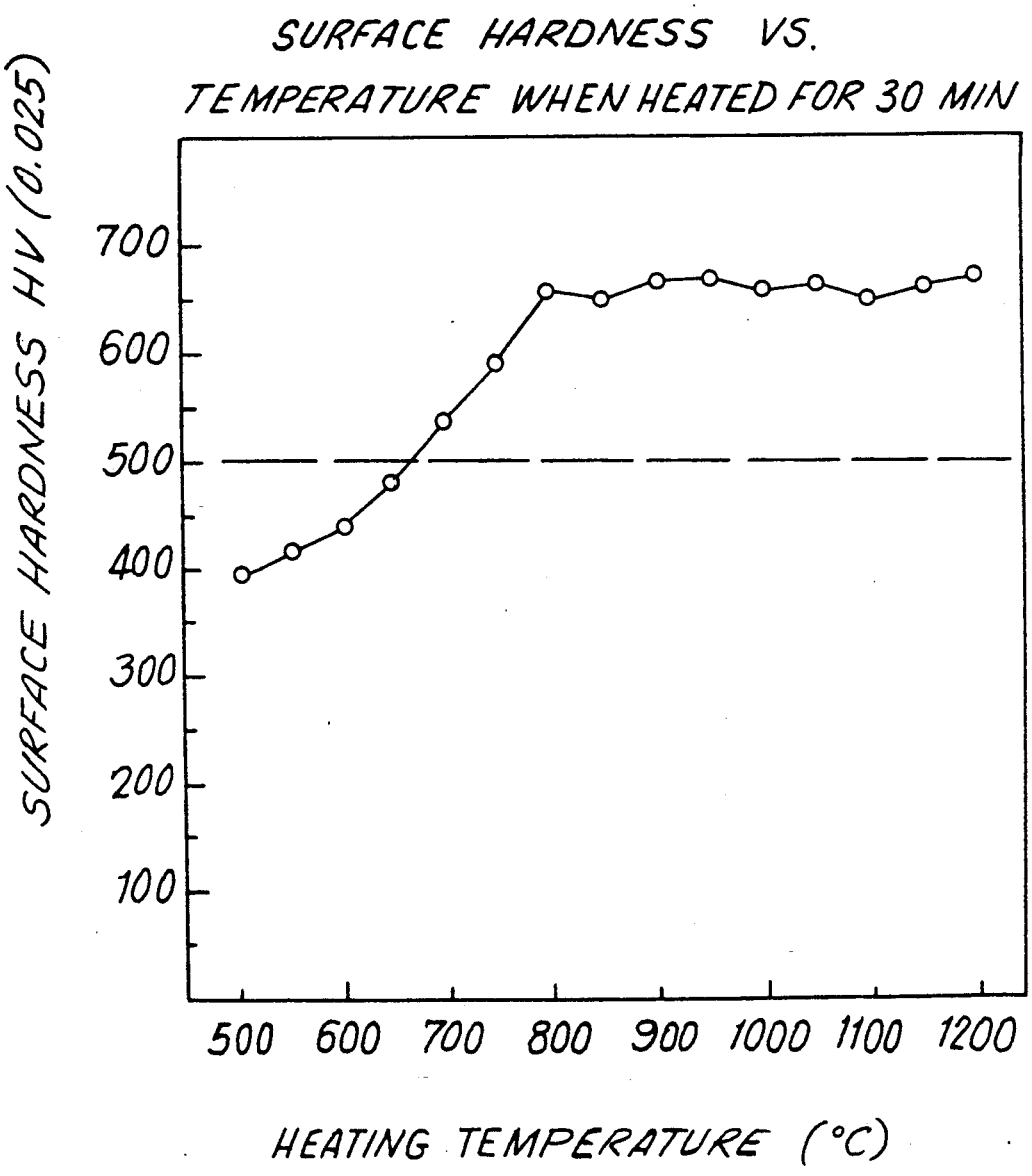
FIG. 3 is a graph showing relationship between heating temperature and surface hardness.

The heat treatment in the heating process is not limited to the above conditions, but may be made at a temperature of 700° C. for a period of 10 hours, or at 1,050° C. for 5 minutes. If the heating temperature is lower than 700° C., hardness (Vickers) Hv of the workpiece is lower than 500 as shown in FIG. 3, resulting in a low abrasion resistance. If the heating temperature is higher than 1,050° C., crystal grains of the titanium alloy formed on the surface of the object material tend to be coarse, resulting in decreases in tensile strength and fatigue resistance and an excessive increase in weight after treatment. Therefore, the heating temperature in the heating process can be flexibly set in the range 700° to 1,050°. In this case, the heating time set longer at a lower heating temperature and shorter at a higher heating temperature, thereby obtaining the same effect as with the above embodiment.

In the above embodiment, after the heating process, the workpiece is quenched by water cooling but, alternatively, it may be cooled by air. The cooling water is typically at room temperature of around 20° C. but may be at temperatures of below 80° C. Using such cooling water, the workpiece is cooled down to near room temperature, typically in about 1 minute. When air-cooled, the workpiece may be allowed to stand until it is cooled to an ambient temperature, or, may alternatively be forcedly cooled to the ambient temperature by blowing a gas such as air, nitrogen, or argon onto the workpiece.

Different heating temperatures in the heating process result in differences in the structure of the oxide films formed on the surface of the titanium alloy.

Figure 4:
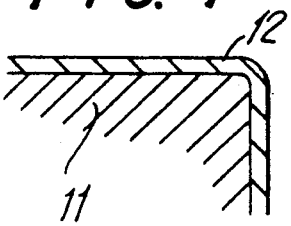
FIGS. 4, 5 and 6 are schematic cross sectional views showing structures of oxide films with different heating temperatures of the heating process.
Figure 5:
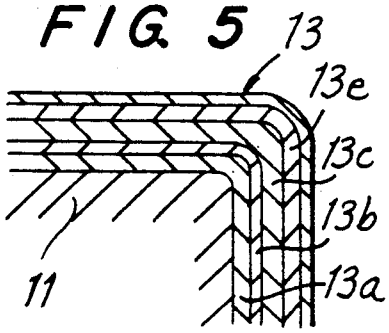
Figure 6:
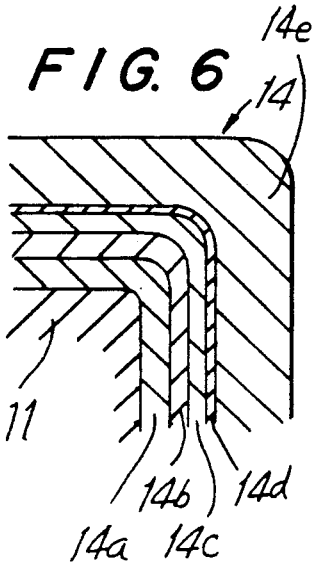

FIGS. 4, 5 and 6 show examples of different structures of oxide film on titanium 11 due to different heating temperatures in the heating process. FIGS. 4, 5 and 6 show the structures of oxide films produced at heating temperatures of 700° to 800° C., 825° to 850° C., and 875° to 1,050° C., respectively. In the case of FIG. 4, a single $TiO_2$ (rutile) layer 12 is formed on the surface of bronze-colored titanium 11. In the cases of FIGS. 5 and 6, composite layers 13 and 14, respectively, comprising a plurality of oxide layers and oxygen-enriched layers are formed on the surface of titanium 11. The composite layer 13 shown in FIG. 5 comprises, from the inner side, a I-layer **13*a* comprising a titanium+$TiO_2$ powder layer, a II-layer 13*b* comprising a $TiO_2$+metallic titanium layer, a III-layer 13*c* comprising a dark blue $TiO_2$ layer, a IV-layer 13*d* comprising a light blue $TiO_2$ layer, and a V-layer 13*e* comprising a yellow-brown $TiO_2$ layer. The composite layer 14 shown in FIG. 6 comprises, from the inner side, a I-layer 14*a* comprising a titanium+$TiO_2$ powder layer, a II-layer 14*b* comprising a $TiO_2$+metallic titanium layer, a III-layer 14*c* comprising a $TiO_2$ layer, a IV-layer 14*d* comprising a $Ti_2O_3$ layer, and a V-layer 14*e*** comprising a dark blue $TiO_2$ layer.

Test results of surface hardness of a workpiece comprising a Ti-22V-4Al alloy treated in Embodiment 1 (pretreatment+oxidation treatment) in comparison with those of a workpiece (Comparative Example 1) subjected only to the oxidation treatment (not pretreated) are shown below.

| Surface hardness | Hv (0.025) |
|---|---|
| Comparative Ex. 1 (not pretreated) | 576, 641, 678, 686 |
| Embodiment 1 (pretreated) | 641, 651, 672, 706 |

As shown above, the workpiece of Embodiment 1 which is oxidation treated after pretreatment shows higher surface hardness than Comparative Example 1. This is considered as due to the fact that adhesion of the oxide film to the titanium alloy is improved.

The oxidation treatment in the above embodiment is that after the heating process, the workpiece is quenched to remove an external oxide scale layer comprising a porous oxide at the outermost layer of the surface composite layer 13. Thus, a hardened layer having almost the same hardness as the valve spring 5 side sliding with the valve spring retainer 4 can be formed to a relatively large thickness (e.g., 100 $\mu$m or more) on the surface of the valve spring retainer 4, thereby improving the burning resistance and abrasion resitance of the Ti-22V-4Al alloy part and preventing an increase in abrasion of the valve spring 5 side sliding with the Ti-22V-4Al alloy part, with improved durability.

Embodiment 2

The valve spring retainer 4 as a workpiece which was not pretreated was oxidation treated by heat treating (heat treatment process) followed by rapidly quenching to remove a scale layer as the outermost layer of the surface composite layer (descaling process), as in Embodiment 1.

After the oxidation treatment, the workpiece was aged by maintaining at 500° C. for 2 hours.

Figure 7:
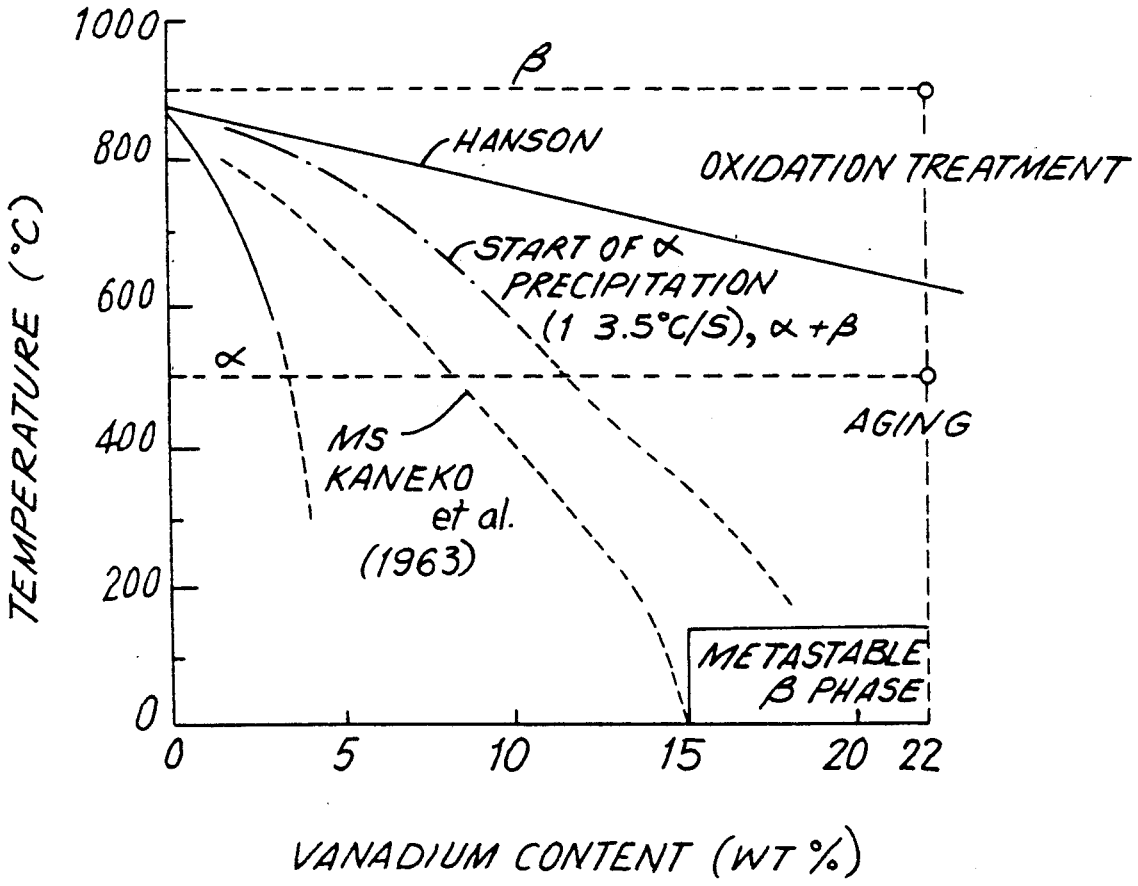
FIG. 7 is a phase diagram in the embodiments.

By the heat treatment at 900° in the oxidation treatment, the workpiece wholly becomes a $\beta$-phase, as shown in FIG. 7. That is, a solution treatment is also made by the heat treatment. After that, by maintaining at 500° C., an α-phase deposits, which is harder than the β-phase, thus achieving aging.

Aging is referred to maintaining at a constant temperature for a predetermined period of time to deposit the α-phase. For the titanium alloy (Ti-22V-4Al) in the above embodiment, aging is accomplished at a temperature of 450° to 550° C. Depending on the strength required for the workpiece, the aging is accomplished in 1 to 10 hours.

Embodiment 3

The workpiece was pretreated and oxidation treated as in Embodiment 1, and then aged as in Embodiment 2.

Effects of aging were confirmed by comparing the object material of this embodiment with that of Embodiment 1.

The following table shows the values of surface hardness and core hardness. As can be seen, hardness of the object material is further improved by the aging, which leads to improved abrasion resistance as will be described later.

| | Surface hardness HV (0.025) | Core hardness HV (10) |
|---|---|---|
| Comp. Ex. 2 (untreated) | 262 | 274 |
| Embodiment 1 (unaged) | 669 | 226 |
| Embodiment 2 (aged) | 704 | 352 |

Figure 8:
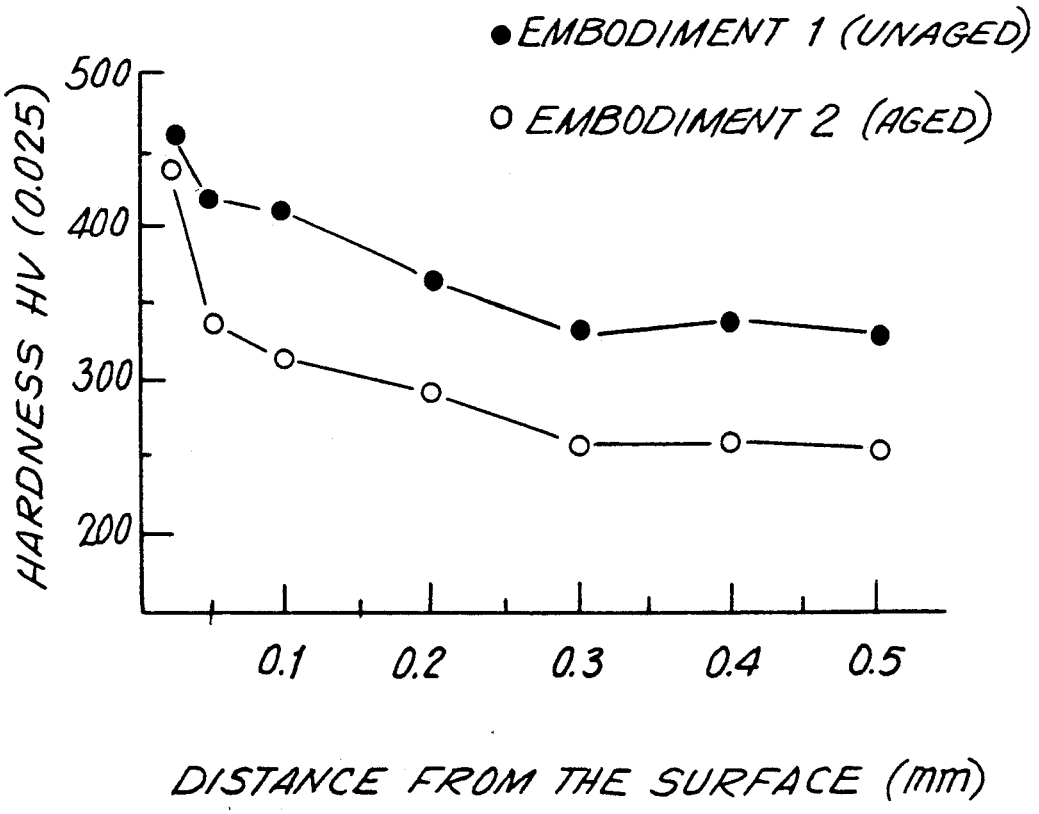
FIG. 8 is a graph showing relationship between distance from the surface and hardness in the embodiments.

FIG. 8 shows experimental results of the relationship between the distance from the surface and hardness (hardness distribution) on a workpiece which was pretreated and oxidation treated as in Embodiment 1 and a workpiece which was subjected to the pretreatment, oxidation treatment, and aging in Embodiment 3.

Comparative Tests

The valve spring retainers 4 of Embodiment 1 (pretreatment+oxidation treatment), Embodiment 2 (oxidation treatment+aging), and Embodiment 3 (pretreatment+oxidation treatment+aging) were subjected to motoring durability tests to measure an abrasion Δt of a seat face 5*a* of the valve spring 5 in the valve spring retainer 4. The results are shown in FIG. 1.

For comparison, Comparative Test 1 which was treated only by the oxidation treatment without pretreatment and Comparative Test 2 which was untreated were also subjected to the same Tests.

Figure 1:
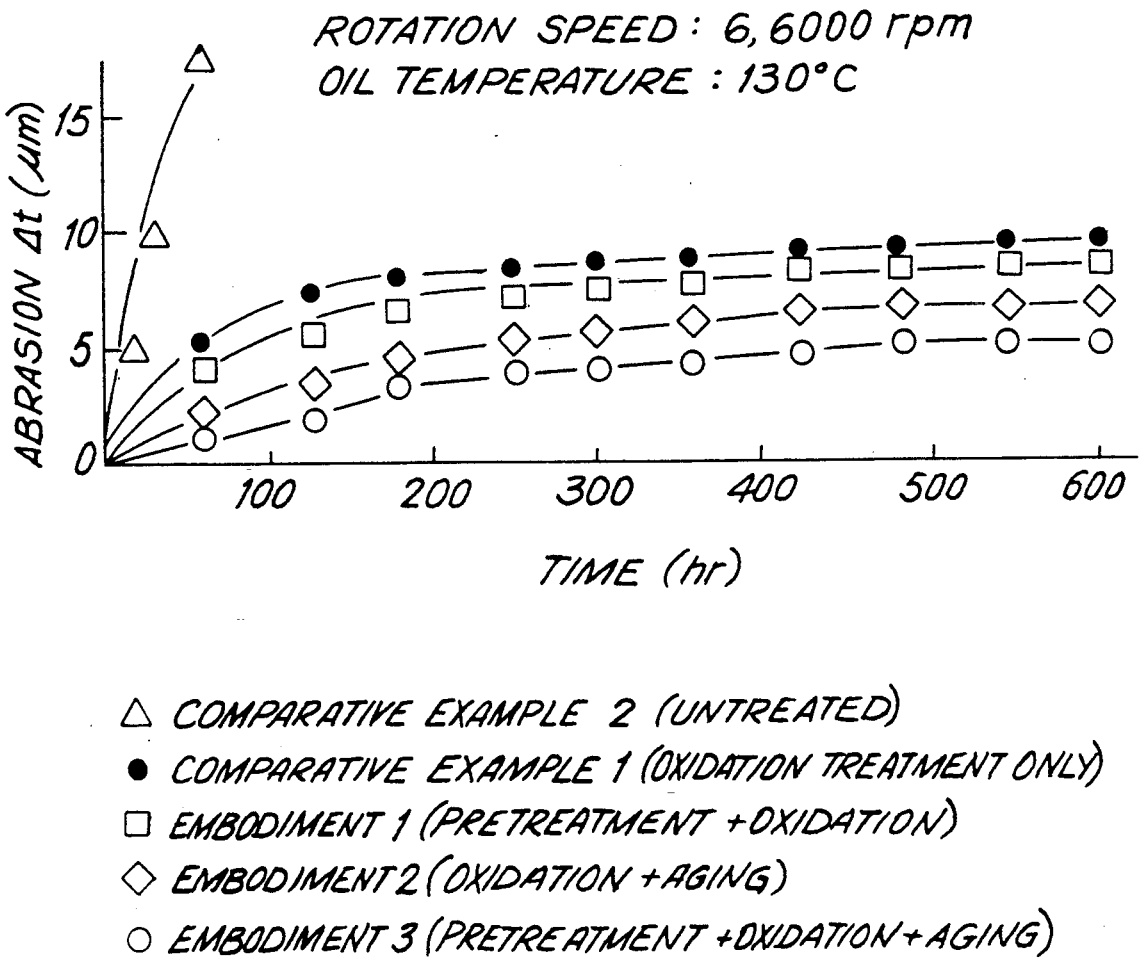
FIG. 1 is a graph showing results of motoring durability tests of a valve spring retainer of embodiments.

From FIG. 1, it is noted that abrasion resistance is improved by pretreatment (Embodiment 1) or aging (Embodiment 2) as compared with Comparative Test 1 which is only oxidation treated, and abrasion resistance is further improved by both pretreatment and aging (Embodiment 3).

The aging temperature, that is, a temperature at which the α-phase deposits, varies with the type of the titanium alloy, and it is necessary to use a temperature suitable for the specific titanium alloy. For example, as in the above embodiment, the β-type Ti-13V-11Cr-3Al alloy is aged at 426° to 482° C., the Ti-3Al-8V-6Cr-4Mo-4Zr (βC) alloy is aged at 375° to 475° C., the α+β-type Ti-6Al-4V alloy is aged at 482° to 538° C., the Ti-6Al-6V-2Sr alloy is aged at 482° to 648° C., the Ti-8Mn alloy is aged at 482° to 510° C., and the near-α-type Ti-8Al-1Mo-1V alloy is aged at 560° to 620° C. As described above, the aging time, although depending on the strength required, is typically 1 to 10 hours.

In the above-described embodiments, the present invention is applied to the valve spring retainer 4. However, the present invention is not limited to this, but may also be embodied in a connecting rod, a valve spring, a valve stem and other specific forms without departing from the spirit or essential characteristics thereof.

We claim:

1. A method for treating the surface of titanium or a titanium alloy comprising the steps of:

pre-treating a workpiece comprising titanium or a titanium alloy with an acid to clean said work piece;

heating said pretreated workpiece in an oxidative atmosphere for a predetermined period of time to form a composite layer comprising oxide layers and oxygen-enriched layers on the surface of said workpiece; and rapidly quenching said workpiece to remove a scale layer formed as an outermost layer of said composite layer on the surface of said workpiece.

2. The method of claim 1 wherein the heating temperature in said heating process is 700° to 1,050° C.

3. The method of claim 2 wherein the heating time in said heating process is shorter at a higher heating temperature and longer at a lower heating temperature.

4. A method for treating the surface of titanium or a titanium alloy comprising the steps of: heating a workpiece to be treated comprising titanium or a titanium alloy in an oxidative atmosphere for a predetermined period of time to form a composite layer comprising oxide layers and oxygen-enriched layers on the surface of said workpiece;

rapidly quenching said workpiece to remove a scale layer formed as an outermost layer of said composite layer on the surface of said workpiece, and aging said work pipes by maintaining said workpiece at a predetermined temperature.

5. The method of claim 4 wherein the heating temperature in said heating process is 700° to 1,050° C.

6. The method of claim 5 wherein the heating time in said heating process is shorter at a higher heating temperature and longer at a lower heating temperature.

7. A method for treating the surface of titanium or a titanium alloy comprising the steps of:

pretreating a workpiece comprising titanium or a titanium alloy with an acid to clean said workpiece;

heating said pretreated workpiece in an oxidative atmosphere for a predetermined period of time to form a composite layer comprising oxide layers and oxygen-enriched layers on the surface of said workpiece;

rapidly quenching said workpiece to remove a scale layer formed as an outermost layer of said composite layer on the surface of the workpiece, and aging said workpiece by maintaining said workpiece at a predetermined temperature.

8. The method of claim 7 wherein the heating temperature in said heating process is 700° to 1,050° C.

9. The method of claim 8 wherein the heating time in said heating process is shorter at a higher heating temperature and longer at a lower heating temperature.

* * * * *